US008579111B2

(12) United States Patent
Elze et al.

(10) Patent No.: US 8,579,111 B2
(45) Date of Patent: Nov. 12, 2013

(54) BASKETBALL STORAGE SYSTEM

(76) Inventors: Olaf Dietrich Elze, Walnut Creek, CA (US); Shawn Finlay Sterling, Walnut Creek, CA (US)

( * ) Notice: Subject to any disclaimer, the term of this patent is extended or adjusted under 35 U.S.C. 154(b) by 34 days.

(21) Appl. No.: 13/068,734

(22) Filed: May 18, 2011

(65) Prior Publication Data

US 2012/0292211 A1 Nov. 22, 2012

(51) Int. Cl.
*B65D 85/00* (2006.01)

(52) U.S. Cl.
USPC ..... 206/315.9; 220/9.4

(58) Field of Classification Search
USPC ..... 206/315.9, 579, 315.91; 220/9.1, 9.2, 220/9.3, 9.4, 476, 480, 481, 617, 694, 200
See application file for complete search history.

(56) References Cited

U.S. PATENT DOCUMENTS

| | | | | | |
|---|---|---|---|---|---|
| 672,417 | A * | 4/1901 | Field | 220/481 |
| 807,092 | A * | 12/1905 | Russell | 119/65 |
| 954,918 | A * | 4/1910 | Biro | 220/9.2 |
| 2,517,757 | A * | 8/1950 | Adlerstein | 312/3 |
| 5,713,502 | A * | 2/1998 | Dixon | 224/542 |
| 6,102,569 | A * | 8/2000 | Wang | 383/104 |
| 6,224,260 | B1 * | 5/2001 | Nickell et al. | 383/119 |
| 6,588,590 | B1 * | 7/2003 | Wang | 206/425 |
| 6,669,045 | B2 * | 12/2003 | Wang | 220/9.2 |
| 6,920,993 | B2 * | 7/2005 | Sheng-Bin | 220/6 |
| 7,841,467 | B2 * | 11/2010 | Slayton | 206/315.1 |
| 2005/0199625 | A1 * | 9/2005 | Salamone | 220/9.2 |
| 2007/0039640 | A1 * | 2/2007 | Zheng | 135/126 |
| 2011/0215095 | A1 * | 9/2011 | Lin | 220/9.4 |

* cited by examiner

*Primary Examiner* — Jacob K Ackun
*Assistant Examiner* — Jenine Pagan
(74) *Attorney, Agent, or Firm* — Robert Samuel Smith

(57) ABSTRACT

A container for equipment, particularly basketballs, being an open box comprising a rigid frame covered by a fitted cloth cover. In one embodiment, the container is open. In another embodiment, the container has a lid that covers the top opening to the container and may be locked in that position. The frame has means for bolting the frame to a vertical wall.

1 Claim, 2 Drawing Sheets

BASKETBALL STORAGE SYSTEM

FIELD OF THE INVENTION

This invention relates to storage systems and particularly to a system for storing sports and playground balls.

BACKGROUND AND INFORMATION DISCLOSURE

A place and means for storing a plurality of balls for sports and playground should have a number of features. It should be locatable in a place that is accessible to a place of play. It should be capable of storing balls in an area that is accessible to where a team will practice.

It should be able to hold a number of balls, perhaps a dozen or so, that can accommodate a plurality of players, perhaps twenty or more for a team or class group. It should be designed to accommodate a rambunctious group of youngsters that are intent on getting out onto the area of play or not overly concentrated on collecting and storing the balls after play or the game period has ended.

U.S. Pat. No. 5,894,951 discloses a basketball storage system having a stanchion extending from a court floor, a backboard on the top end of the stanchion, a rim attached to the backboard, a net hanging down from the rim and a container for holding basketball. The container is attached to the stanchion so at least one basketball (30) is available for a basketball game.

U.S. Pat. No. 6,267,461 discloses a ball storage apparatus including a ball container defined by a wall and having an upper portion and a lower portion. The ball container has a mouth large enough for a ball to pass there through. The mouth is disposed toward the upper portion of the ball container. An opening, large enough for the ball, is disposed in the wall, toward the lower portion of the ball container.

U.S. Pat. No. 6,006,772 discloses a collapsible structure that can be easily and quickly folded into a compact configuration. The collapsible structures have at least three foldable frame members, each having a folded and an unfolded orientation. A fabric material covers each frame member to form a panel for each frame member when the frame member is in the unfolded orientation, with the fabric assuming the unfolded orientation of its associated frame member.

None of these systems provide a system of ball storage that provides the ease of accessibility for the number of balls, contemplated for the present invention.

SUMMARY OF THE INVENTION

It is an object of this invention to provide a container for storing a dozen or so sports and playground balls. It is contemplated that the container be arranged and have sufficient capacity to permit a stream of players to haphazardly throw or drop the balls into the container and retrieve the balls without having to "stretch down" over an edge of the container to reach a ball at the bottom of the container.

It is another object that the container be fixable in a convenient location such as a gym, locker, garage, outdoor wall, fence or training facility.

It is another object that the container be lightweight.

It is another object that the container be easy to assemble and dissemble as required.

This invention is directed toward a container being a frame of elongated members over which a cloth cover is fitted. The container is open on top to facilitate "dropping" balls into the container.

Openings are provided in at least one side of the container through which balls can be conveniently withdrawn.

One vertical side of the container is attachable to a fitting that is bolted to a wall.

In another embodiment each of the two vertical elongated openings in the front wall of the container are fitted with a zipper that can be locked when the zippers are in the closed position.

In yet another embodiment, a cloth roof is attached along the top edge of the rear vertical wall. The roof can be extended over the container and locked to the top edge of the front vertical wall When the container of balls is closed and locked, balls inside the locked container are inaccessible

DESCRIPTION OF A BEST MODE

Figure 1:
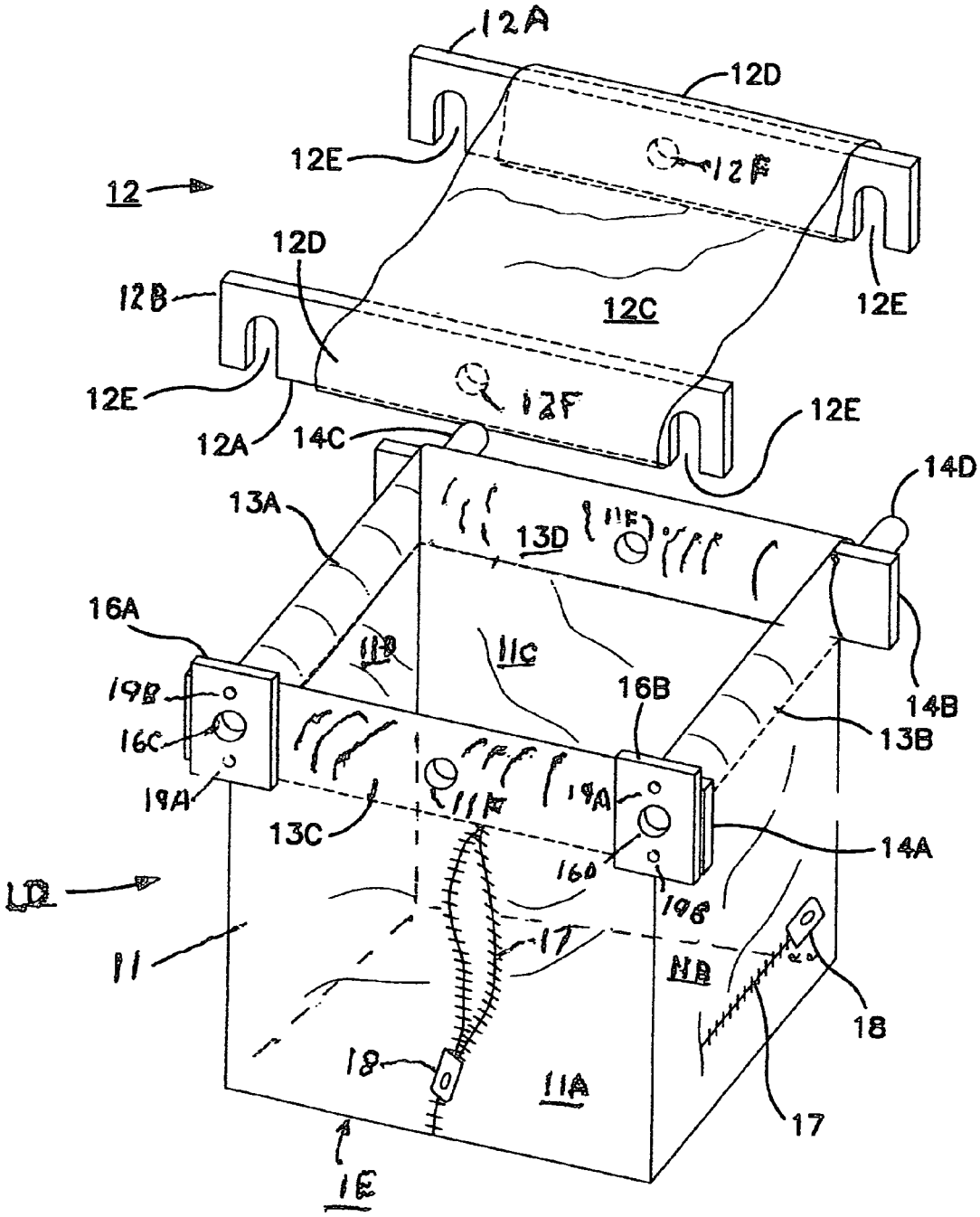
FIG. 1 is an assembly view of the invention.

Turning now to a description of the drawings, FIG. 1 shows the assembled storage container of this invention for storing basketballs.

A lid is positioned over an open canvas enclosure 11. The rectangular opening of canvas enclosure 11 is formed by two rods 14C,D joined to two bars 14A,B.

Figure 2:
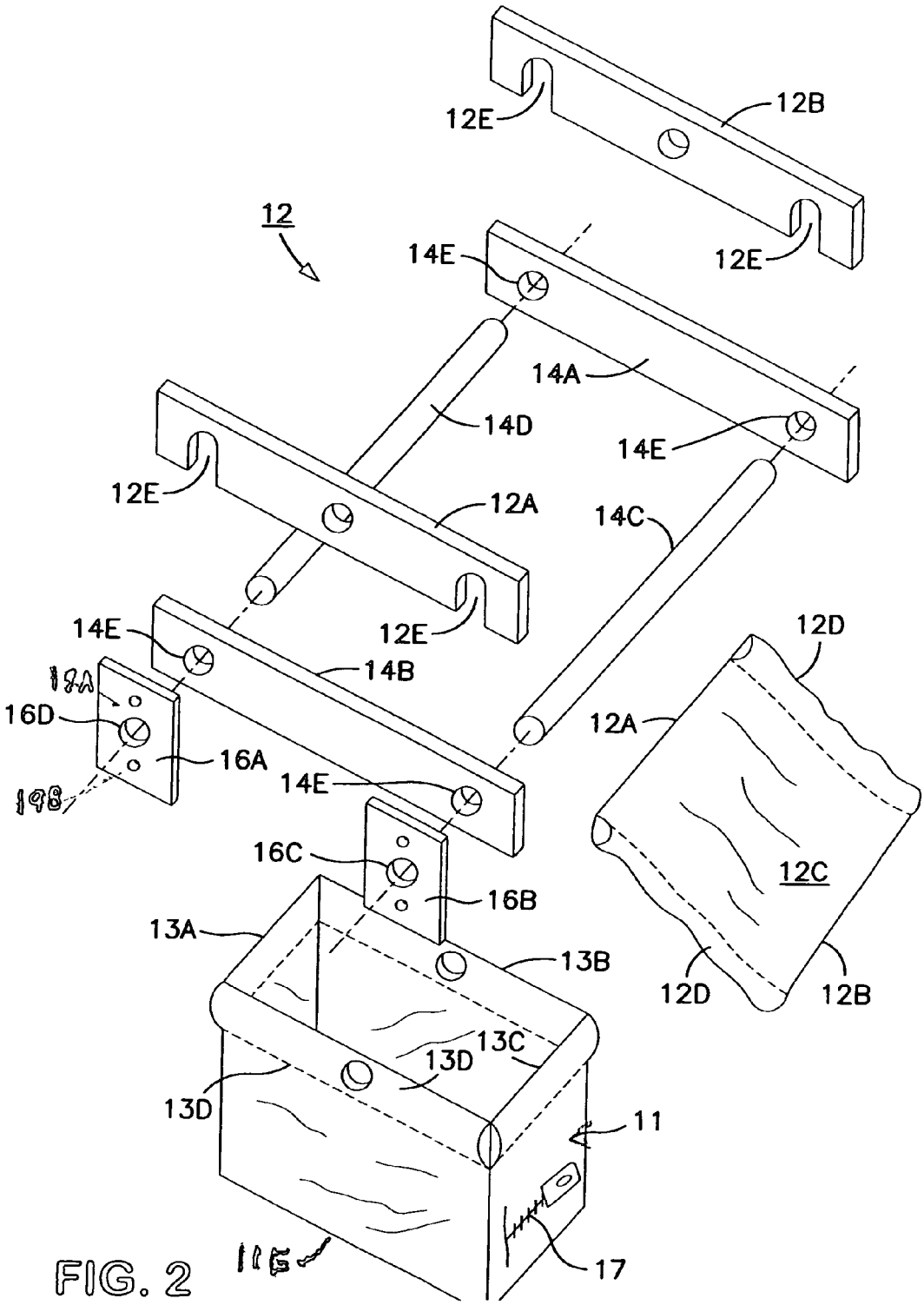
FIG. 2 is a view of the frame to which a cloth cover is secured.

FIG. 2 is an exploded view of the assembly shown in FIG. 1. The upper edges 13A,B,C,D of canvas enclosure 11 is formed by sleeves which receive bars 14A,B and rods 14 C,D respectively.

One end of bars 114C,D respectively engage a pair of anchor plates 16A,B. Anchor plates 16A,B may be bolted to a vertical wall (wall not shown) if it is required that the container 10 be stationary in a designated location.

Lid 12 comprises a cloth sheet having an opposite pair of sleeve edges 12D secured which slide onto beams 12A, and 12B.

Each beam has a pair of slots 12E so that lid 12 may rest on the top edge of container 11 with slots 12E respectively engaging rods 14D.

A pair of support rods 14C,D in container 11 are shown. Each rod 14C,D has an end for dimensioned for fitted insertion into a hole 16C,D in a respective anchor plate 16 A,B.

When an end of each rod 14C,D is inserted into a respective hole 16 C,F of a plate 16 C,D bolted to a wall, each rod is anchored perpendicular to the wall parallel to the other rod 14D,C.

The pair of bars 12A,B are shown with a hole 14E in each end of the bars 14A,B. The free end of each rod 14C,D fits snugly into a hole 16E in a respective one of plates 16A.B.

Each bar 14A,B, has a hole 14E in each end. The holes 14E in each bar 14A,B are dimensioned to permit sliding an end of each rod 14C,D through a respective hole 14E in the bars 14A,B thereby forming a rectangular frame.

When an end of each rod 14C,D of the frame is fitted into a hole 16C,D in the plate bolted to the wall, the frame of bars and rods is perpendicular to the wall.

FIG. 1 shows the cloth box having a flap 17 (door) over an opening in the side of the cloth box 10. A zipper 18 is shown providing that the opening 17 may be opened or closed by the zipper thereby providing direct access to the floor of the cloth box. Zipper 18 has a handle 18 with an opening so that the zipper handle that may be locked to a loop attached to the cloth box so that the flap may be locked when it is desired to prevent access to the bottom of the box.

There has been described a container that is conveniently adaptable to storing athletic equipment, particularly sports and playground balls. The container is supported by a rigid frame that is attachable to a vertical wall. The lightweight cloth-frame construction ensures ease in moving the container from one location to another.

What is claimed is:

1. A container (10) for storing items comprising:

a rigid frame 12 including:

a rear bar (14A) a front bar (14B), a first rod (14C) and a second rod (14D);

said rear bar (14A) and front bar (14B) being elongated and having a rectangular cross section and said first rod (14C) and second rod (14D) being elongated and having a round cross section;

said rear bar 14(A) and front bar (14(B) having a bar opening (14E) at each end with an end of each rod (14C, 14D) extending through a respective one of said bar openings (14E) such as to provide said rigid rectangular frame (12);

a rectangular cloth enclosure (11) having:

four rectangular cloth side panels (11A,B,C,D) and a rectangular cloth floor panel (11E) comprising a cloth enclosure (11);

a tubular cloth sleeve (13A,B,C,D) secured entirely along a top edge of said cloth enclosure (11);

said first bar (14A), second bar 14B, first rod 14C, and second rod 14D positioned respectively through said sleeve (13A,B,C,D);

one anchor plate (16A) and another anchor plate (16B), each anchor plate having an opening (16C, 16D) respectively for receiving an end of one of said first and second rods (14C, 14D);

each anchor plate having screw holes (19A,19B) for receiving screws to secure said each anchor plate flush against a vertical supporting wall with said frame having ends of said first and second rods inserted in respective openings of said anchor plates and said frame extending away from said supporting wall providing that said enclosure is hangable from said frame and extends toward a floor supporting said wall;

a lid (12) for said cloth enclosure including:

a rectangular lid sheet (12C) of cloth;

two lid bars (12A, B) having an equal length;

one edge of said lid sheet (12C) fastened to one said lid bar (12A) along a long dimension of one said lid bar and an opposite edge of said lid sheet fastened to another lid bar (12B) along a long dimension of said another lid bar;

said lid bars (12A,B) parallel to one another and spaced from one another to permit laying each lid bar (12A,B) along a long dimension of said another lid bar 12 (BA);

said lid bars (12A,B) parallel to one another and spaced from one another to permit laying each lid bar (12A,B) on said frame (12) with a pair of notches (12E) in each lid bar engaging a respective edge of said frame bars (14A,B) and said lid sheet covering said top opening of said cloth enclosure (11) whereby said lid is removable from said cloth enclosure (11) to provide access to an interior of said enclosure (11);

one of said side panels having a bottom opening (17) proximal to said bottom panel arranged to permit withdrawing any one of said items through said opening from said cloth box;

a zipper (18) on edges of said opening (17) arranged for opening and closing said opening (17);

whereby said container is arrangeable to permit users to enter items into said enclosure through said top opening when said lid is removed and permit users to with draw items from said enclosure.

* * * * *